US012006682B2

(12) United States Patent
Siver et al.

(10) Patent No.: US 12,006,682 B2
(45) **Date of Patent: *Jun. 11, 2024**

(54) BULLET RESISTANT WALL SYSTEM

(71) Applicant: 360° Ballistics, LLC, Wake Forest, NC (US)

(72) Inventors: Mark Alan Siver, Youngsville, NC (US); Clayton Dean Amidon, Zebulon, NC (US)

(73) Assignee: 360° Ballistics, LLC, Wake Forest, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/989,311

(22) Filed: Nov. 17, 2022

(65) Prior Publication Data

US 2023/0228083 A1 Jul. 20, 2023

Related U.S. Application Data

(63) Continuation of application No. 16/918,400, filed on Jul. 1, 2020, now Pat. No. 11,505,940, which is a (Continued)

(51) Int. Cl.
*E04B 2/08* (2006.01)
*E04B 2/02* (2006.01)

(Continued)

(52) U.S. Cl.
CPC ..... *E04B 2/08* (2013.01); *F41H 5/02* (2013.01); *F41H 5/0414* (2013.01); *F41H 5/24* (2013.01);

(Continued)

(58) Field of Classification Search
CPC ..... E04B 2/08; E04B 2002/0208; F41H 5/02; F41H 5/0414; F41H 5/24; F41J 11/02; F41J 13/00
See application file for complete search history.

(56) References Cited

U.S. PATENT DOCUMENTS 4,046,582 A 9/1977 Kawamura et al.
4,075,808 A 2/1978 Pearlman (Continued)

FOREIGN PATENT DOCUMENTS

WO 2012020229 A1 2/2012

OTHER PUBLICATIONS

Hudson, Kenneth L. et al., Final Report Demonstration of Shock-Absorbing Concrete (SACON) Bullet Trap Technology (Report No. ATC-8183), Aug. 1999, 219 pages, U.S. Army Environmental Center, Aberdeen Proving Ground, MD 21010-5401.

(Continued)

*Primary Examiner* — Rick K Chang
(74) *Attorney, Agent, or Firm* — NEO IP

(57) ABSTRACT

A bullet resistant wall system including ballistic paver blocks constructed, configured, and arranged to form a wall having at least two adjacent individual layers. The at least two adjacent individual layers include multiple adjacent rows of the ballistic paver blocks. The ballistic paver blocks are formed from wet ballistic concrete prepared without an addition of a preformed foam or wet ballistic concrete prepared without an addition of a stabilizing agent.

9 Claims, 13 Drawing Sheets

Related U.S. Application Data continuation of application No. 15/440,126, filed on Feb. 23, 2017, now Pat. No. 10,704,256, which is a continuation-in-part of application No. 14/268,435, filed on May 2, 2014, now Pat. No. 9,604,321.

(60) Provisional application No. 62/352,700, filed on Jun. 21, 2016, provisional application No. 61/818,873, filed on May 2, 2013.

(51) Int. Cl.

| | |
|---|---|
| ***F41H 5/02*** | (2006.01) |
| ***F41H 5/04*** | (2006.01) |
| ***F41H 5/24*** | (2006.01) |
| ***F41J 11/02*** | (2009.01) |
| ***F41J 13/00*** | (2009.01) |

(52) U.S. Cl.

CPC ..... *F41J 11/02* (2013.01); *F41J 13/00* (2013.01); *E04B 2002/0208* (2013.01)

(56) References Cited

U.S. PATENT DOCUMENTS

| | | | |
|---|---|---|---|
| 4,249,948 | A | 2/1981 | Okada et al. |
| 4,391,664 | A | 7/1983 | Kramer |
| 4,488,910 | A | 12/1984 | Nicholson et al. |
| 4,683,800 | A | 8/1987 | Snedeker |
| 4,737,193 | A | 4/1988 | Gutmann et al. |
| 4,979,425 | A | 12/1990 | Sprague |
| 5,131,791 | A | 7/1992 | Kitziller |
| 5,456,752 | A | 10/1995 | Hogan |
| 5,976,656 | A | 11/1999 | Giraud |
| 6,244,009 | B1 | 6/2001 | Cerrato |
| 6,264,735 | B1 | 7/2001 | Bean et al. |
| 6,423,134 | B1 | 7/2002 | Trottier et al. |
| 6,568,310 | B2 | 5/2003 | Morgan |
| 6,582,511 | B1 | 6/2003 | Velpari |
| 6,620,236 | B2 | 9/2003 | Huntsman et al. |
| 6,688,811 | B2 | 2/2004 | Forrester |
| 6,758,020 | B2 | 7/2004 | Cerrato |
| 6,758,897 | B2 | 7/2004 | Rieder et al. |
| 6,782,673 | B2 | 8/2004 | Azar |
| 6,972,100 | B2 | 12/2005 | Minke et al. |
| 7,111,847 | B2 | 9/2006 | Larson et al. |
| 7,243,921 | B2 | 7/2007 | Larson et al. |
| 7,357,394 | B2 | 4/2008 | Halverson |
| 7,562,613 | B2 | 7/2009 | Ahmad |
| 7,628,104 | B2 | 12/2009 | Warren et al. |
| 7,677,151 | B2 | 3/2010 | Ahmad |
| 7,748,307 | B2 | 7/2010 | Hallissy et al. |
| 7,845,266 | B2 | 12/2010 | Duke et al. |
| 7,849,780 | B1 | 12/2010 | Hallissy et al. |
| 8,043,982 | B2 | 10/2011 | Telander |
| D662,225 | S | 6/2012 | Amidon et al. |
| 8,479,464 | B2 | 7/2013 | Holzworth |
| 8,959,862 | B1 | 2/2015 | Kreizinger |
| 9,021,761 | B2 | 5/2015 | Riccobene et al. |
| 9,074,850 | B2 | 7/2015 | Bergiadis |
| 9,121,675 | B1 | 9/2015 | Amidon et al. |
| 9,440,883 | B1 | 9/2016 | Brien |
| 9,604,321 | B1 | 3/2017 | Amidon et al. |
| 11,505,940 | B2 * | 11/2022 | Siver ..... F41J 13/00 |
| 2003/0051418 | A1 | 3/2003 | Crowder |
| 2007/0062143 | A1 | 3/2007 | Noushad |
| 2008/0092471 | A1 | 4/2008 | Ahmad |
| 2008/0275149 | A1 | 11/2008 | Ladely et al. |
| 2009/0020044 | A1 | 1/2009 | Constantz et al. |
| 2009/0049778 | A1 | 2/2009 | Kralic et al. |
| 2009/0162626 | A1 | 6/2009 | Konishi et al. |
| 2009/0169855 | A1 | 7/2009 | Tunis |
| 2009/0282969 | A1 | 11/2009 | Ahmad |
| 2009/0293711 | A1 | 12/2009 | Altergott et al. |
| 2010/0083819 | A1 | 4/2010 | Mann et al. |
| 2010/0229715 | A1 | 9/2010 | Tonyan et al. |
| 2010/0230035 | A1 | 9/2010 | Frank et al. |
| 2010/0326336 | A1 | 12/2010 | Struthers et al. |
| 2011/0107904 | A1 | 5/2011 | Queheillalt et al. |
| 2011/0197789 | A1 | 8/2011 | Novak et al. |
| 2013/0012625 | A1 | 1/2013 | Li et al. |
| 2014/0116235 | A1 | 5/2014 | Berroth et al. |
| 2014/0150362 | A1 | 6/2014 | Propst |
| 2015/0315798 | A1 | 11/2015 | Propst |
| 2016/0289121 | A1 | 10/2016 | Coleman |
| 2017/0160059 | A1 | 6/2017 | Amidon et al. |
| 2017/0175388 | A1 | 6/2017 | Siver et al. |
| 2017/0234659 | A1 | 8/2017 | Amidon et al. |
| 2020/0332520 | A1 | 10/2020 | Siver et al. |
| 2020/0340784 | A1 | 10/2020 | Siver |
| 2021/0010788 | A1 | 1/2021 | Amidon et al. |
| 2021/0239433 | A1 | 8/2021 | Amidon et al. |

OTHER PUBLICATIONS

Technical Specification for Shock Absorbing Concrete (SACON. RTM.)-Shock Absorbing Concrete for Constructing Live-Fire Training Facilities, Document metadata bears creation date of Feb. 12, 2007, 25 pages, U.S. Army Corps of Engineers.

Whiting, David A., Manual on Control of Air Content in Concrete, 1998, 52 pages, Portland Cement Association, Skokie, Illinois, USA.

www.graceconstruction.com, Grace Concrete Products Darafill Dry Controlled low strength material perfomance additive. (Year: 2007).

* cited by examiner

BULLET RESISTANT WALL SYSTEM

CROSS REFERENCE TO RELATED APPLICATIONS

This nonprovisional utility patent application is related to and claims priority from one or more prior filed applications. The present application is a continuation of U.S. Non-provisional patent application Ser. No. 16/918,400 filed Jul. 1, 2020, which is a continuation of U.S. Non-provisional patent application Ser. No. 15/440,126 filed Feb. 23, 2017, which is a continuation-in-part of U.S. Non-provisional patent application Ser. No. 14/268,435 filed May 2, 2014, which claims the benefit of U.S. Provisional Patent Application No. 61/818,873 filed May 2, 2013, each of which is incorporated herein by reference in its entirety. U.S. Non-provisional patent application Ser. No. 15/440,126 also claims priority to and the benefit of U.S. Provisional Patent Application No. 62/352,700, filed Jun. 21, 2016, each of which is incorporated herein by reference in its entirety.

BACKGROUND OF THE INVENTION

1. Field of the Invention

The present invention relates to bullet resistant walls, and more specifically to retrofitting a preexisting wall to achieve bullet resistance.

2. Description of the Prior Art

It is generally known in the prior art to attach solid metal or metal mesh to structures in order to enhance their structural characteristics.

U.S. Pat. No. 7,562,613 for protective structure and protective system by inventor Ahmad, filed Nov. 30, 2005 and issued Jul. 21, 2009, is directed to a protective structure for protecting buildings, bridges, roads and other areas from explosive devices such as car bombs and the like comprises: (a) a mesh structure having an outer surface and an inner surface, wherein the inner surface defines an annular space; (b) a plurality of structural steel cables in contact with the mesh structure; (c) a composite fill material which resides within the annular space of the mesh structure and within the mesh structure; (d) at least one reinforcement member which resides within the composite fill material; and (e) a composite face material which resides upon the outer surface of the mesh structure. The mesh structure may be made up of, for example, steel wire. A protective system for protecting buildings, bridges, roads and other areas from explosive devices such as car bombs and the like comprises a plurality of the above described protective structures and a plurality of support members, wherein the support members provide interlocking engagement of the protective structures to the support members.

U.S. Pat. No. 7,677,151 for protective structure and protective system by inventor Ahmad, filed Jul. 7, 2009 and issued Mar. 16, 2010, is directed to a protective structure for protecting buildings, bridges, roads and other areas from explosive devices such as car bombs and the like comprises: (a) a mesh structure having an outer surface and an inner surface, wherein the inner surface defines an annular space; (b) a plurality of structural steel cables in contact with the mesh structure; (c) a composite fill material which resides within the annular space of the mesh structure and within the mesh structure; (d) at least one reinforcement member which resides within the composite fill material; and (e) a composite face material which resides upon the outer surface of the mesh structure. The mesh structure may be made up of, for example, steel wire. A protective system for protecting buildings, bridges, roads and other areas from explosive devices such as car bombs and the like comprises a plurality of the above described protective structures and a plurality of support members, wherein the support members provide interlocking engagement of the protective structures to the support members.

U.S. Pat. No. 7,748,307 for shielding for structural support elements by inventor Hallissy et. al., filed Aug. 4, 2006 and issued Jul. 6, 2010 is directed to a shield for shielding a structural member from an explosive blast or accidental or malicious destruction is provided. The shield includes a plurality of shield members which include cast ultra high strength concrete, wherein the shield members are capable of being assembled to enclose at least a portion of the structural member to provide protection to the enclosed portion from, for example, an explosive blast. In one embodiment, the shield members include a chassis, at least one ballistic liner disposed on the energy absorbing layer, and a concrete-integrating structure.

U.S. Pat. No. 5,976,656 for shock damper coating by inventor Giraud, filed May 15, 1997 and issued Nov. 2, 1999 is directed to the damper coating for shocks produced by a collision, or impacts produced by a shockwave, contains at least one layer of a crushing material (2) intended to cover a surface to be protected, the external layer of the crushing material (2) being, according to the present invention, covered by a skin (4) capable of providing a widening of the area affected by the shock or impact. The skin (4) contains, in particular, several layers ($5_1$; $5_2$; $5_3$) of scales ($6_1$; $6_2$; $6_3$), the scales of one layer being offset in staggered rows with respect to the scales of the following layer and being separated from the neighbouring scales of the same layer or capable of being separated from the latter on the application of the shock or impact. The structure of this damper coating is designed to dampen the impact under a reduced thickness.

U.S. Pat. No. 6,972,100 for Method and system for providing articles with rigid foamed cementitious cores by inventor Minke et al., filed Apr. 29, 2003 and issued Dec. 6, 2005, is directed to one aspect of the present invention pertains to an apparatus for forming a rigid foamed cementitious core within a plurality of article shells. In general, the apparatus can be comprised of a shell bank for retaining a plurality of article shells and comprising a sled and a plurality of reinforcement shells, a filing station for delivering a gas-entrained cementitious material, and a pump. The gas-entrained cementitious material cures to form a rigid foamed cementitious core within each article shell in the plurality of article shells.

U.S. Pat. No. 4,391,664 for process for fixing tiles in position by inventor Kramer, filed Sep. 2, 1980 and issued Jul. 5, 1983, is directed to a process for fixing wear-resistant armoring tiles to cement mortar. In accordance with the process, the back sides of the tiles are coated with a mixture of polyester epoxy resin composition including sand and quartz or sand powder, with a curing agent. A material having an affinity for the cement mortar (like quartz sand or lavalite) is dusted and rolled into the coated back side of the tiles, so as to thoroughly be mixed up with the resin mixture coating. After the hardening of the coating including the material having affinity to cement mortar, the tiles are embedded in the cement mortar. Accordingly, this process substantially eliminates the well-known poor adhesive properties of such tiles with respect to cement mortar.

U.S. Pat. No. 7,849,780 for shielding for structural support elements by inventor Hallissy et al, filed Mar. 17, 2009 and issued Dec. 14, 2010, is directed to a shield for shielding a structural member from an explosive blast or accidental or malicious destruction is provided. The shield includes a plurality of shield members which include cast ultra high strength concrete, wherein the shield members are capable of being assembled to enclose at least a portion of the structural member to provide protection to the enclosed portion from, for example, an explosive blast. In one embodiment, the shield members include a chassis, at least one ballistic liner disposed on the energy absorbing layer, and a concrete-integrating structure.

U.S. Patent App. 20140150362 for building panels and method of forming building panels by inventor Propst, filed Dec. 13, 2013 and published Jun. 5, 2010, is directed to a building panel structure is disclosed, in which building panels are used to form a structure. Roof panels and roof panel tiles are disclosed, which can be used to form the roof of the structure. The roof panels and the building panels include a core and a coating covering a portion of the core. In some embodiments the core consists of a frame and at least one insulating structural block. The insulating structural blocks can be encapsulated polystyrene (EPS) foam blocks. In some embodiments the coating includes ceramic material. In some embodiments the coating includes a first layer and a second layer. In some embodiments the coating is used to retrofit preexisting wall structures. The roof panel and the roof tile can be shaped, formed, and colored to look like traditional roof tiles such as shake roof tiles or Spanish roof tiles.

U.S. Patent App. 20150315798 for building panels and method of forming building panels by inventor Propst, filed Jun. 23, 2015 and published Nov. 5, 2015, is directed to a building panel structure is disclosed, in which building panels are used to form a structure. Roof panels and roof panel tiles are disclosed, which can be used to form the roof of the structure. The roof panels and the building panels include a core and a coating covering a portion of the core. In some embodiments the core consists of a frame and at least one insulating structural block. The insulating structural blocks can be encapsulated polystyrene (EPS) foam blocks. In some embodiments the coating includes ceramic material. In some embodiments the coating includes a first layer and a second layer. In some embodiments the coating is used to retrofit preexisting wall structures. The roof panel and the roof tile can be shaped, formed, and colored to look like traditional roof tiles such as shake roof tiles or Spanish roof tiles.

U.S. Patent App. 20090282969 for protective structure and protective system by inventor Ahmad, filed Jul. 7, 2009 and published Nov. 19, 2009, is directed to a protective structure for protecting buildings, bridges, roads and other areas from explosive devices such as car bombs and the like comprises: (a) a mesh structure having an outer surface and an inner surface, wherein the inner surface defines an annular space; (b) a plurality of structural steel cables in contact with the mesh structure; (c) a composite fill material which resides within the annular space of the mesh structure and within the mesh structure; (d) at least one reinforcement member which resides within the composite fill material; and (e) a composite face material which resides upon the outer surface of the mesh structure. The mesh structure may be made up of, for example, steel wire. A protective system for protecting buildings, bridges, roads and other areas from explosive devices such as car bombs and the like comprises a plurality of the above described protective structures and a plurality of support members, wherein the support members provide interlocking engagement of the protective structures to the support members.

U.S. Patent App. 20080092471 for protective structure and protective system by inventor Ahmad, filed Nov. 30, 2005 and published Apr. 24, 2008, directed to a protective structure for protecting buildings, bridges, roads and other areas from explosive devices such as car bombs and the like comprises: (a) a mesh structure having an outer surface and an inner surface, wherein the inner surface defines an annular space; (b) a plurality of structural steel cables in contact with the mesh structure; (c) a composite fill material which resides within the annular space of the mesh structure and within the mesh structure; (d) at least one reinforcement member which resides within the composite fill material; and (e) a composite face material which resides upon the outer surface of the mesh structure. The mesh structure may be made up of, for example, steel wire. A protective system for protecting buildings, bridges, roads and other areas from explosive devices such as car bombs and the like comprises a plurality of the above described protective structures and a plurality of support members, wherein the support members provide interlocking engagement of the protective structures to the support members.

SUMMARY OF THE INVENTION

The present invention relates to the addition of bullet resistance to a preexisting wall thereby providing enhanced safety in a more economical and efficient method than through traditional modification techniques.

It is an object of this invention to provide a process for retrofitting a wall to provide enhanced bullet and projectile resistance. It is another object of the present invention to incorporate ballistic cement in accordance with U.S. Pat. No. 9,121,675 into ballistic paver blocks for use in retrofitting preexisting walls. It is another object of the present invention to provide a wall retrofitting process that is more cost-effective than prior techniques. It is further an object of the present invention to provide a wall retrofitting process that is lighter than traditional concrete gap filling, thereby reducing structural impact of buildings. It is a further object of the present invention to incorporate a repairing process in accordance with U.S. patent application Ser. No. 14/268,435, filed May 2, 2014 in order to repair retrofitted walls. U.S. patent application Ser. No. 14/268,435 is incorporated by reference herein in its entirety.

In one embodiment, the present invention provides a method of retrofitting a preexisting wall for bullet resistance comprising the steps of: acquiring ballistic paver blocks; selecting a preexisting wall to be augmented; selecting a side of the preexisting wall to be augmented; applying a row of the ballistic paver blocks in the first layer; applying subsequent rows of the ballistic paver blocks in the first layer; applying subsequent layers of the ballistic paver blocks.

In another embodiment, the present invention provides a bullet resistant wall comprising: ballistic paver blocks; wherein the ballistic paver blocks are constructed, configured and arranged to create a wall with multiple layers, wherein the multiple layers are formed by multiple rows of the ballistic paver blocks that are offset so that seams do not overlap other seams in the multiple layers.

In yet another embodiment, the present invention provides a bullet resistant wall comprising: ballistic paver blocks, wherein the bullet resistant wall does not contain any metal shielding or metal mesh.

These and other aspects of the present invention will become apparent to those skilled in the art after a reading of the following description of the preferred embodiment when considered with the drawings, as they support the claimed invention.

DETAILED DESCRIPTION

Figure 1:
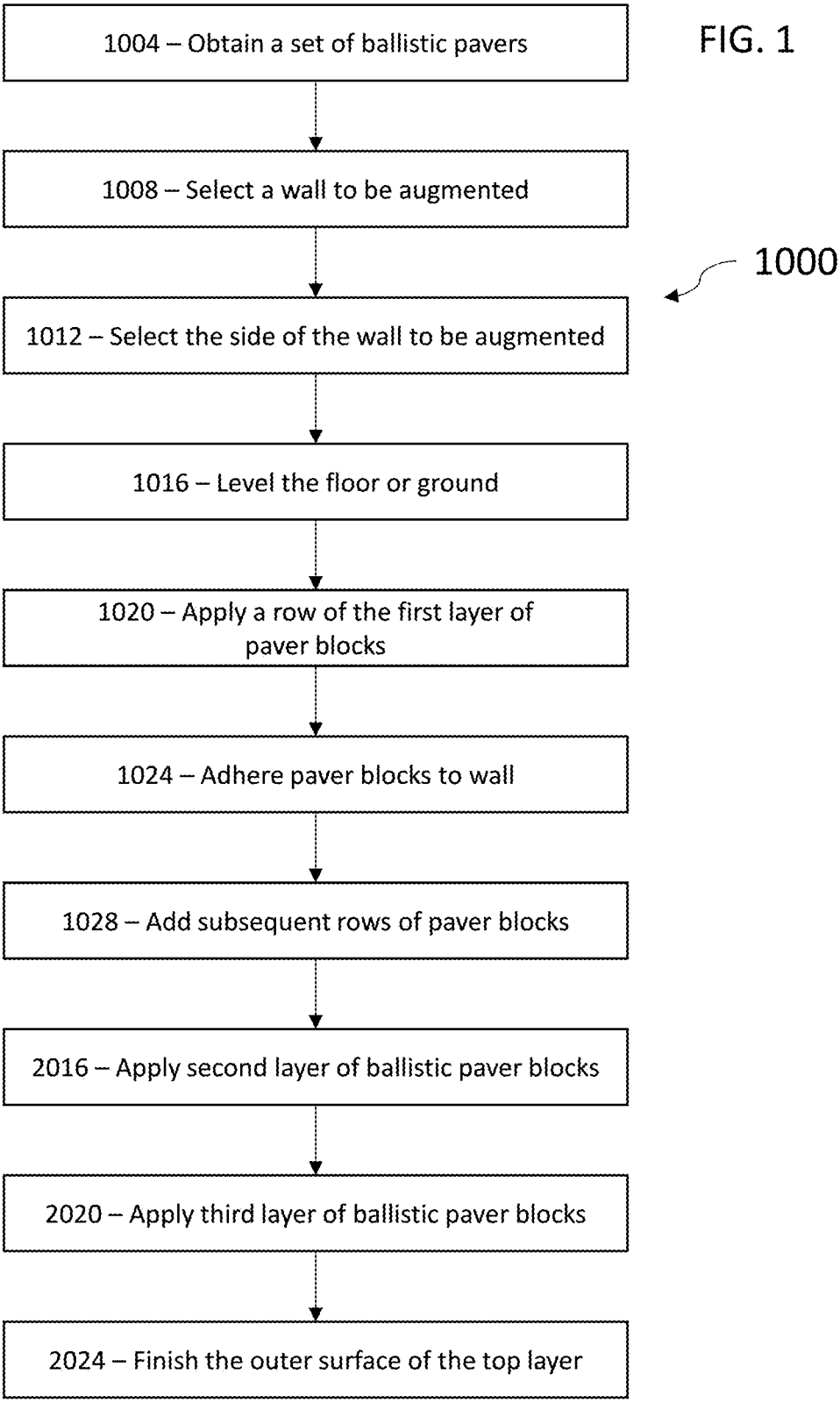
FIG. 1 illustrates a sequence of steps associated with retrofitting a preexisting wall to provide bullet resistance, according to one embodiment of the present invention.

The present invention is generally directed to systems and methods for providing bullet resistance to a preexisting wall by retrofitting the preexisting wall with supplemental layers of ballistic concrete formed by at least one layer of ballistic concrete masonry units.

In one embodiment, the present invention provides a method of retrofitting a preexisting wall for bullet resistance including the steps of: acquiring ballistic paver blocks; selecting a preexisting wall to be augmented; selecting a side of the preexisting wall to be augmented; applying a row of the ballistic paver blocks in the first layer; applying subsequent rows of the ballistic paver blocks in the first layer; applying subsequent layers of the ballistic paver blocks.

In another embodiment, the present invention provides a bullet resistant wall including: ballistic paver blocks; wherein the ballistic paver blocks are constructed, configured and arranged to create a wall with multiple layers; wherein the multiple layers are formed through multiple rows of the ballistic paver blocks, wherein seams formed by abutting edges of the ballistic paver blocks are offset to avoid overlapping seams, i.e., no abutting edges of a first layer are aligned with abutting edges of a second or subsequent layer.

In yet another embodiment, the present invention provides a bullet resistant wall system including: ballistic paver blocks constructed and configured to form at least one layer, wherein the bullet resistant wall does not contain or include any metal shielding or metal mesh.

The creation of stand-alone bullet resistant walls utilizing ballistic concrete wall panels twenty-four to thirty inches thick for use in a live-fire training facility is well known in the art. These large structures are appropriate as the walls need to withstand repeated exposure to live fire while retaining an adequate ability to stop bullets from getting from one side of the ballistic concrete panel to the other. However, such massive components require heavy equipment to move and take up a large amount of space. Large concrete wall panels would not be a convenient or practical solution for hardening a school or office building against penetration from a limited number of bullets.

In contrast, traditional building construction using steel stud frames or concrete masonry units (cinder blocks) will not stop a NATO M80 round (7.62 NATO) and the revised round known as the Enhanced Performance Round (EPR) can penetrate concrete masonry unit walls from forty to eighty meters depending on the rifle used. Filling a cinderblock wall with mortar may add to the stability of the wall, but mortar does not have stopping power for bullets or other projectiles. Additionally, solid filling the cinderblock walls with concrete would be expensive and require deconstruction of sections of wall. Thus, most buildings are vulnerable to bullets. In light of highly publicized attacks upon schools with a shooter armed with an assault rifle, there is an unmet need to be able to harden preexisting walls in buildings.

Referring now to the drawings in general, the illustrations are for the purpose of describing a preferred embodiment of the invention and are not intended to limit the invention thereto.

FIG. 1 shows a sequence of steps 1000 to incorporate bullet resistance into a preexisting wall according to one embodiment of the present invention.

STEP 1004—Obtain a set of ballistic paver blocks for use in the project. In one embodiment of the present invention, the dimension of the ballistic paver blocks is 12 inches by 12 inches by 3 inches. In an alternative embodiment, the ballistic paver blocks have a surface face of between 144 and 324 square inches. In an alternative embodiment, the ballistic paver blocks have a surface face of between 16 and 64 square inches. In an alternative embodiment, the ballistic paver blocks have a surface face of between 64 and 144 square inches. In one embodiment of the present invention, the ballistic paver blocks are square. Alternatively the ballistic paver blocks are rectangular. In a preferred embodiment of the present invention the ballistic paver blocks will be as large as is convenient for the application. Using larger paver blocks means fewer blocks to move and adhere to the wall. Additionally, larger ballistic paver blocks create fewer seams and are desirable because a bullet that happens to hit a seam may penetrate through the seam more easily than penetrating through a non-seam section of the ballistic paver block.

In a preferred embodiment of the present invention, the ballistic paver blocks are made using ballistic concrete in accordance with the process set forth in U.S. Pat. No. 9,121,675, issued Sep. 1, 2015, which is hereby incorporated by reference in its entirety. Alternatively, the ballistic paver blocks are made with SACON® ballistic concrete prepared following the specifications set forth in the "Technical Specification for Shock Absorbing Concrete (SACON®)—Shock Absorbing Concrete for Constructing Live-Fire Training Facilities" and described in U.S. Pat. No. 6,264,735 issued Jul. 24, 2001, and U.S. Pat. No. 6,620,236 issued Sep. 16, 2003, which are hereby incorporated by reference in their entirety. Alternatively, the ballistic paver blocks are made with ballistic concrete prepared in some other manner where the ballistic concrete is used to allow bullets to be captured rather than ricochet off of the ballistic paver block when striking the paver block substantially perpendicularly.

Step 1008—Select a preexisting wall to be augmented. In one embodiment of the present invention the preexisting wall is an interior wall. Alternatively the preexisting wall is an exterior wall. In one embodiment of the present invention the preexisting wall is made from conventional steel studs with drywall. Alternatively the preexisting wall can be made of concrete masonry units (CMUs—sometimes called cinder blocks). Alternatively the preexisting wall is made using any other conventional building technique.

Step 1012—Select the side of the preexisting wall to be augmented. In one embodiment of the present invention the preexisting wall is an exterior wall. When determining which side of the wall is to be augmented, many factors are considered. By way of example and not limitation, factors include the need to maintain interior square footage. In another embodiment of the present invention the ballistic paver blocks are placed against the face of the preexisting wall anticipated to be closer to the shooter. Alternatively, the ballistic paver blocks are placed against the face of the preexisting wall anticipated to be farther away from the shooter.

Step 1016—Level the floor or ground in the region that will receive ballistic paver blocks. This is an optional step as some buildings have walls that are flat and level by the edge of the wall to be enhanced. By way of example and not limitation, a user may snap a line to mark what is level, then shim or use some other methods known to those skilled in the art to get a level base for the ballistic paver blocks.

Figure 2:
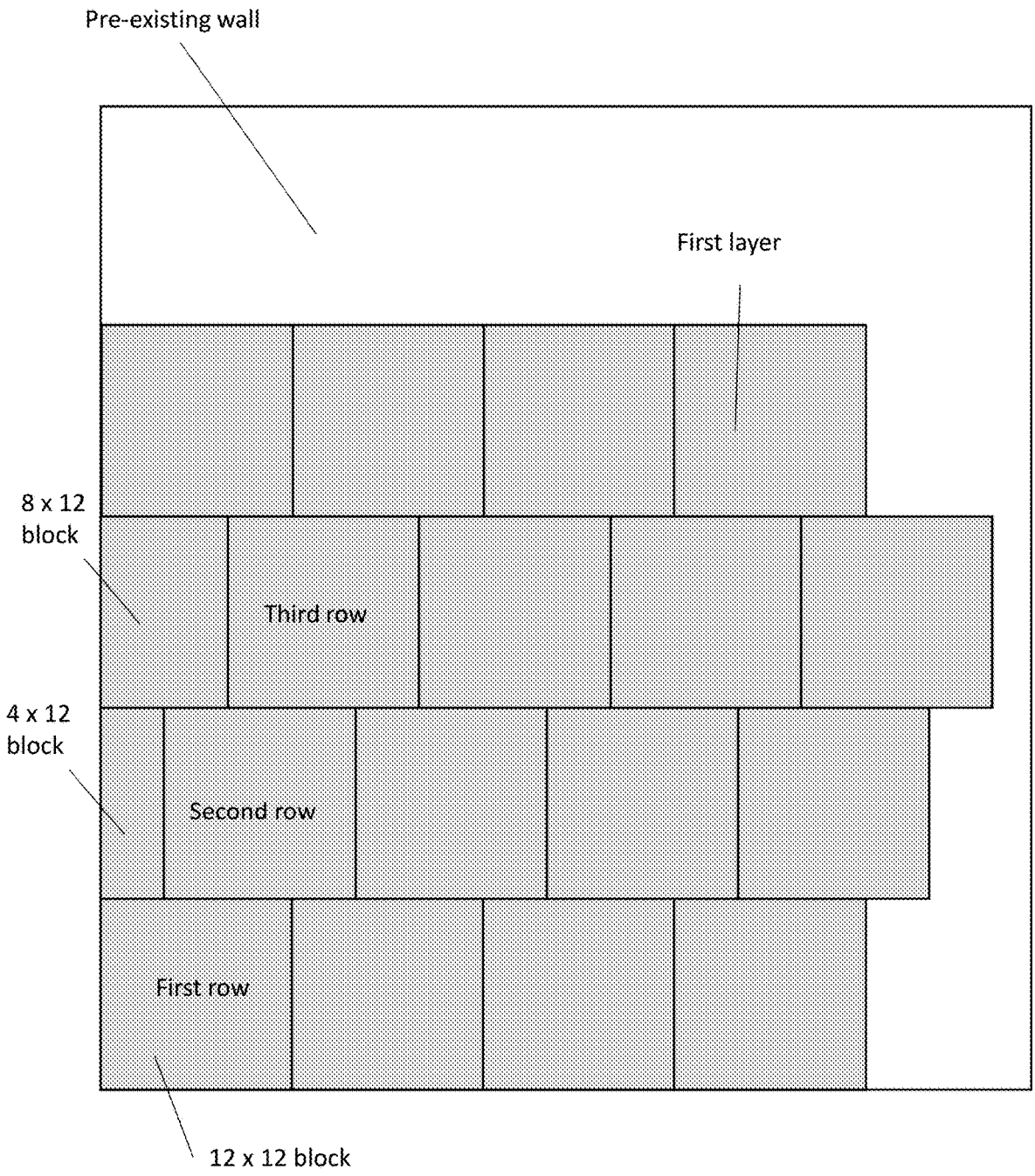
FIG. 2 illustrates a front view of a wall with a first layer of ballistic paver blocks according to one embodiment of the present invention.

Step 1020—Apply a row of the first layer of ballistic paver blocks. FIG. 2 illustrates a front view of a wall with a first layer of ballistic paver blocks according to one embodiment of the present invention. In one embodiment of the present invention the ballistic paver blocks are 12 inches square and 3 inches thick. Alternatively the ballistic paver blocks can be in a different dimensional configuration depending on requirements of the final product and the limitations associated with the work space. In one embodiment of the present invention the row is premeasured so that custom ballistic paver blocks fit flush against the abutting wall. In another embodiment of the present invention the wall is built with standard sized ballistic paver blocks and the last ballistic paver block before the end of the wall is cut with a saw. The ballistic paver blocks are readily field cut with a tile saw or other saw used to cut analogous material.

For a wall that is to be protected that will abut another wall to be protected in an inside corner, run the first row of the first layer of the first wall to be protected to the corner. Run the first row of the first layer of the second wall to be protected until making contact with the first wall.

In a preferred embodiment of the present invention, the seams between adjacent ballistic paver blocks do not need to be filled with traditional mortar as the flat edges of the ballistic paver blocks will fit together. This is advantageous as traditional mortar does not have bullet resistance characteristics, and thereby eliminating mortar reduces the surface of the wall that is not resistant to bullets. Additionally, any gaps in the seams for one layer of ballistic paver blocks will be covered by subsequent offset layers of ballistic paver blocks, thereby ensuring sufficient bullet resistance across the entire augmented wall face. In another embodiment the gaps between ballistic paver blocks is filled in with traditional mortar. This can be advantageous to modify ballistic paver block spacing, thereby ensuring subsequent ballistic paver block layers are offset from previous ballistic paver block layers.

Step 1024—Adhere the ballistic paver block to the wall using a mastic such as a landscaping mastic used for attaching stone or masonry elements in hardscaping. In one embodiment of the present invention the ballistic paver blocks are adhered to the preexisting wall using a construction mastic. In another embodiment the ballistic paver blocks are adhered to the preexisting wall using an alternative adhesive appropriate for the work environment. By way of example and not limitation, a taller wall consisting of ballistic paver blocks requires a stronger adhesive to ensure the stability of the augmented wall and safety of those in its proximity. Those of skill in the art will be able to select an appropriate construction adhesive for use with the present disclosure.

In one embodiment of the present invention the adhesive is placed only on the singular face of each individual ballistic paver block that contacts the preexisting wall or previous layers of ballistic paver blocks. In this configuration the adhesive is used to ensure the ballistic paver blocks do not slip away from the wall. The combined weight of the ballistic paver blocks is transferred down to the floor and therefore no adhesive on the bottom of the ballistic paver blocks is required. In another embodiment of the present invention, where the shape of the augmented wall warrants it, adhesive can be applied to every side of the ballistic paver blocks.

Step 1028—Add the subsequent rows to the first row of the first layer of ballistic paver blocks. In a preferred embodiment each row of ballistic paver blocks is offset from the row below (closer to the floor). By way of example and not limitation, the first row starts with a 12 inch wide ballistic paver block, the second row starts with a 4 inch wide ballistic paver block, and the third row starts with an 8 inch ballistic paver block, as illustrated in FIG. 2. The pattern then repeats until the top of the preexisting wall. Alternatively, the offset is 2 inches. Alternatively the offset is 3 inches. Alternatively the offset is 5 inches. Alternatively the offset is the width of the ballistic paver blocks divided by the number of layers in the augmented wall. In a preferred embodiment of the present invention, the magnitude of the offset from one row to the next is utilized in every layer of the augmented wall, thereby preventing overlapping seams.

Figure 3:
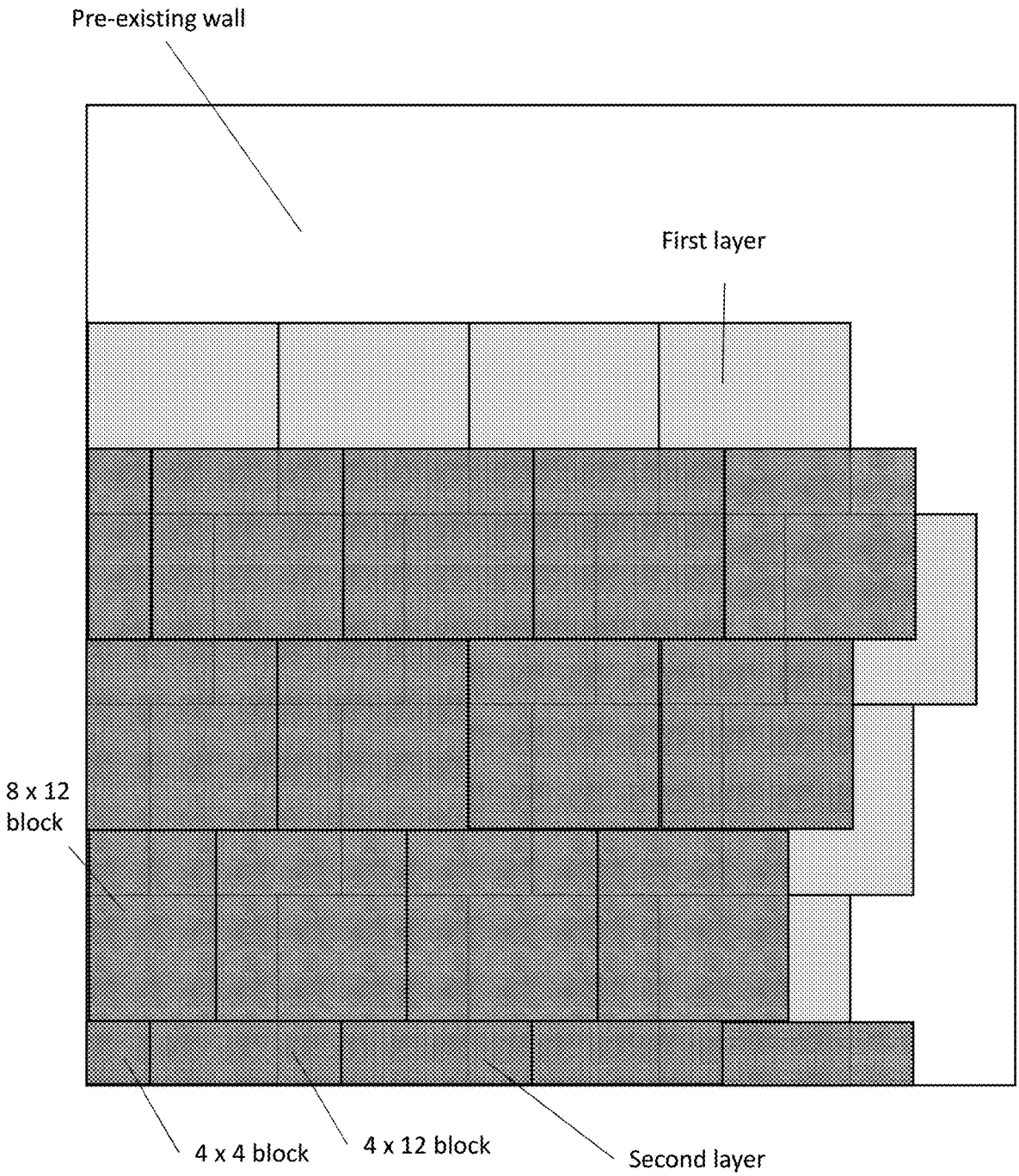
FIG. 3 illustrates a front view of a wall with a first and second layer of ballistic paver blocks according to one embodiment of the present invention.

Step 2016—Apply a second layer of ballistic paver blocks. In a preferred embodiment of the present invention, the second layer of ballistic paver blocks are offset from the first layer of ballistic paver blocks so that none of the horizontal seams of the second layer of ballistic paver blocks align with the horizontal seams of the first layer of ballistic paver blocks FIG. 3 illustrates a front view of a wall with a first and second layer of ballistic paver blocks according to one embodiment of the present invention. By way of example and not limitation, the first row of the second layer consists of ballistic paver blocks that are 4 inches by 12 inches by 3 inches rather than the ballistic paver blocks measuring 12 by 12 by 3 used in the first layer. This offsets the horizontal seams by 4 inches.

Additionally, the ballistic paver blocks are placed so that none of the vertical seams on the second layer of ballistic paver blocks matches up with the vertical seams of the first layer of ballistic paver blocks. In one embodiment of the present invention, a first ballistic paver block of 4 by 4 by 3 inches is used and 4 by 12 by 3 inch ballistic paver blocks are used for the remainder of the first row across the floor. The second layer is shown semi-transparent in FIG. 3. The next row is offset a different amount than the second row of the first layer. Therefore the second row of the second layer is offset 8 inches rather than the 4 inch lateral offset of the second row of the first layer. For example, an 8×12 inch first block is used, with subsequent blocks being 12×12. This process continues with ballistic paver blocks of the second layer being adhered to the first layer of ballistic paver blocks and the last ballistic paver block in each row being field cut to fill the remaining space. The top row of ballistic paver blocks is field cut to fit the gap between the second to last row and the ceiling. One skilled in the art will realize that there are many variations of the present invention depending on the number of ballistic paver blocks available, size of wall, level of bullet protection needed, etc.

Figure 4:
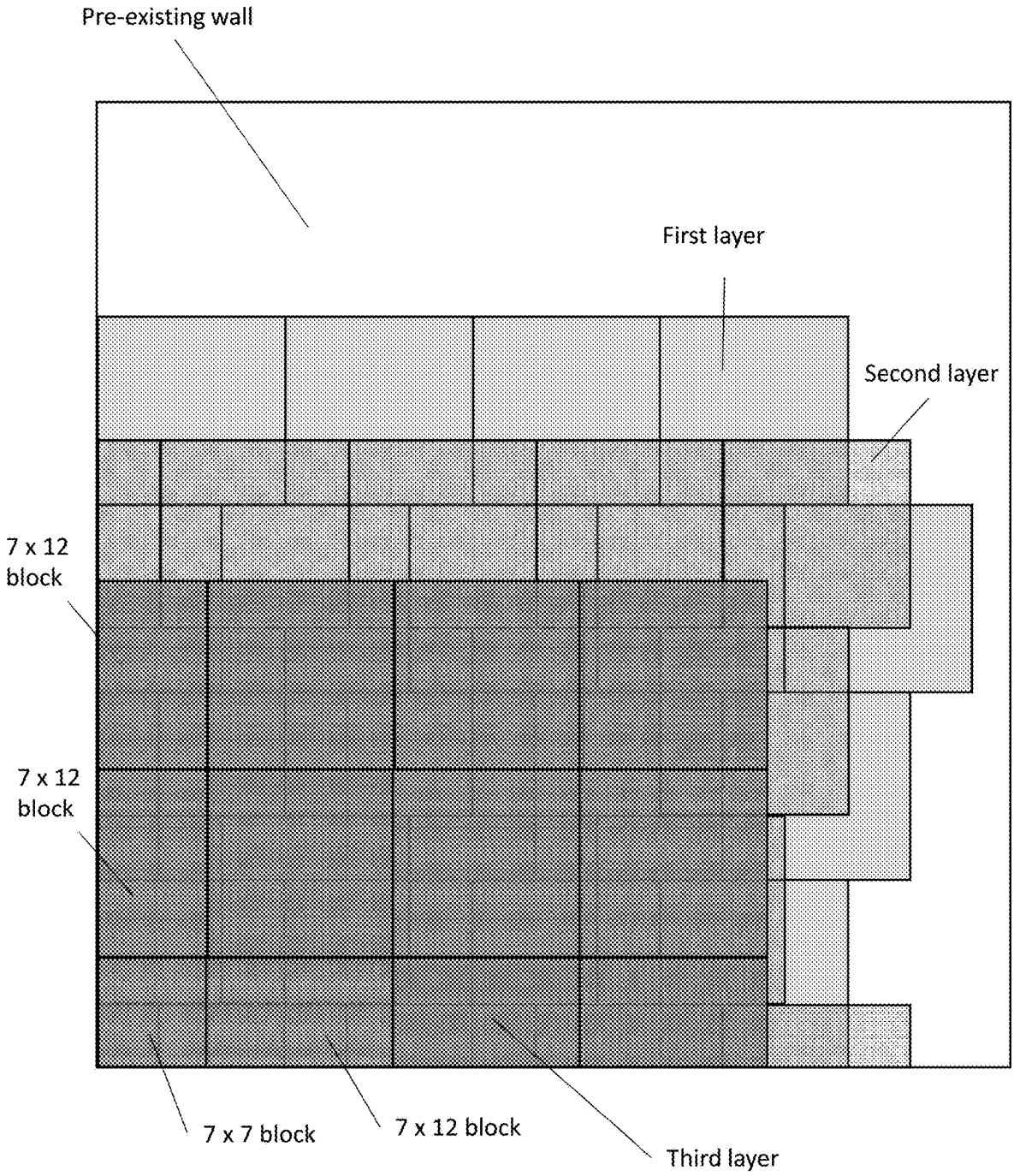
FIG. 4 illustrates a front view of a wall with three layers of ballistic paver blocks according to one embodiment of the present invention.

Step 2020—Apply the third layer of ballistic paver blocks. In a preferred embodiment of the present invention, the ballistic paver blocks of the third layer are arranged so that the vertical and horizontal seams for the third row of ballistic paver blocks do not match the vertical or horizontal seams of the second or first layers of ballistic paver blocks. By way of example and not limitation, one embodiment of the present invention consists of a 7 inch square ballistic paver block at the start edge on the floor and then completing the first row with 7 inch by 12 inch ballistic paver blocks laid with the 12 inch side parallel to the floor. FIG. 4 illustrates a front view of a wall with three layers of ballistic paver blocks according to one embodiment of the present invention. The third layer is shown semi-transparent in FIG. 4. The subsequent rows of ballistic paver blocks on the third layer all start with a 7×12 inch ballistic paver block. One skilled in the art will realize that there are many variations of the present invention depending on the number of ballistic paver blocks available, size of wall, level of bullet protection needed, etc.

One of skill in the art will recognize that the offsets used to start the second or third layer may be used for the first layer. The sequence of layer offsets is not important so the repeating pattern of offsets from vertical row to vertical row could be (0, 4, 8) (4, 8, 0); (8, 0, 4) (8, 4, 0) (4, 0, 8) or (0, 8, 4).

Figure 5:
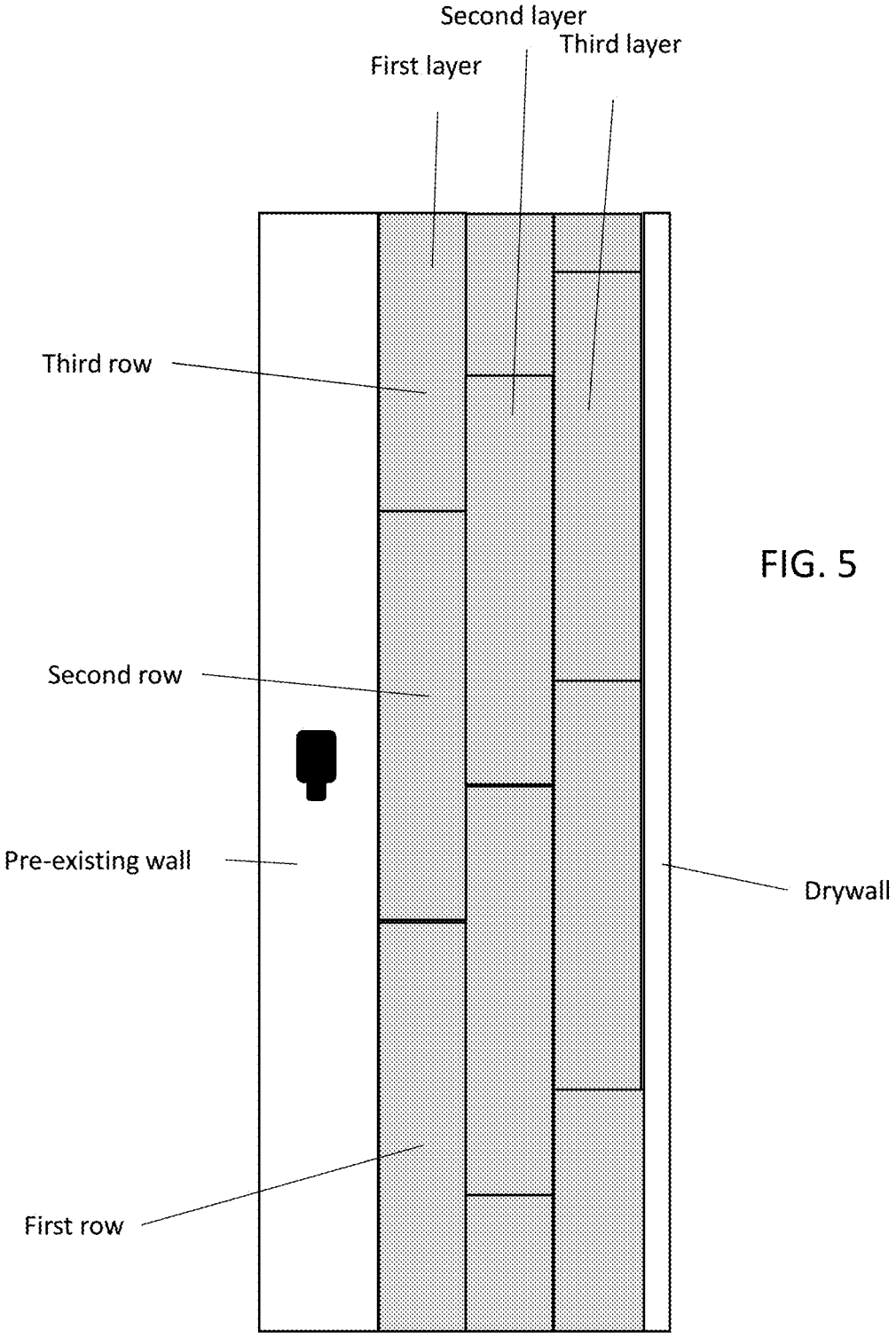
FIG. 5 illustrates a side view of a wall with three layers of ballistic paver blocks and drywall according to one embodiment of the present invention.

Step 2024—Finish the outer surface of the top layer of pavers. In one embodiment of the present invention the wall is finished with drywall. The drywall is attached to the top layer of ballistic paver blocks using masonry screws. Alternatively the drywall can be attached using other methods. By way of example and not limitation, the drywall can be attached with adhesives. In another embodiment of the present invention the wall is finished with other surface treatments. By way of example and not limitation, the wall can be finished with paint. FIG. 5 is a side view of a finished wall with three layers of ballistic paver blocks and drywall.

Alternate embodiments of the present invention include augmenting the exterior face of walls. In one embodiment of the present invention, ballistic paver blocks on exterior side of an exterior wall are covered with conventional facades including, by way of example and not limitation, brick, stucco, or masonry board. In another embodiment the exterior ballistic paver blocks are covered for ornamental appearance. Alternatively the ballistic paver blocks are covered to tactically conceal the location of augmented walls.

Test Results

A bullet resistant wall with three layers of 12 inch by 12 inch by 3 inch ballistic paver blocks with offsetting vertical and horizontal seams, according to one embodiment of the present invention, was shot repeatedly with a NATO M80 round (7.62 NATO) using an Armalite AR-10 rifle with a 20 inch barrel. The shots were filed substantially perpendicular to the augmented wall. The distance from the gun to the wall was well under 82 feet and is thus unimportant as the velocity of such a bullet is constant for the first 82 feet. The depths of penetration of the bullets measured from the outermost ballistic paver block to the trailing end of the projectile were in the range of 2.5 to 3 inches. This is a small fraction of the 9 inch total depth of ballistic paver blocks according to this embodiment of the present invention, so a second shot that hit the same bullet hole would not be able to traverse the ballistic paver blocks.

Alternative and Variations

In an alternate embodiment of the present invention, the ballistic paver blocks are applied to numerous walls to create a safe room. A safe room is a place where staff and visitors or students retreat when there is an active shooter situation. It is preferred that the safe room have a door that is itself resistant to bullets or other projectiles such as from a grenade.

While this disclosure has described a system that uses three layers of 3 inch thick ballistic paver blocks, other combinations are possible. Those of skill in the art will recognize that not all three layers of ballistic paver blocks need be the same thickness. A designer may choose to use two layers of ballistic paver blocks that are 4 inches thick and one layer of ballistic paver blocks that is 2 inches thick. The total of the layers does not have to add up to 9 inches. Depending on the type of anticipated threat, the budget for the project, and the practical constraints of how much space can be consumed in a preexisting space, 9 inches may not be the selected choice. An area that is only seeking to be hardened against hand guns as it is unlikely that a rifle could be carried to that location may choose a lower level of bullet resistance to add to interior walls.

A location seeking to harden exterior walls for a possible threat from a 50 caliber sniper round might seek a larger total depth for the set of layers. A location that may receive a number of bullets in a small area of wall such as from a fully automatic weapon or a machine gun may seek to have a larger total depth for the set of layers.

An alternative embodiment includes a wall wherein some of the layers are ballistic concrete and some of the layers are normal or non-ballistic concrete. For example, in a wall composed of three layers, the outer two layers are ballistic concrete and the third, inner layer is normal concrete. In this manner, the outer two layers will absorb the round and, should the round have enough kinetic energy to penetrate these two layers, the normal concrete layer will offer more potential to stop the round than if it were ballistic cement.

In yet another embodiment, the layers have different densities. For example, the middle layer is a higher density to better stop high-kinetic energy projectiles. The lower-density inner and outer layers prevent spalling. Alternatively, the densities can increase from front to back.

The current disclosure expresses that a preferred embodiment has three or more layers of ballistic paver blocks. Specifically, there is an advantage to having three layers rather than two layers. Because a bullet that happens to hit a seam may penetrate through the barrier more easily than had the bullet not hit the seam, by using at least 3 layers and configuring the blocks so none of the seams overlap, a bullet that goes into a seam can only travel through one third (⅓)

of the barrier through that seam. In contrast, in a barrier with only two layers, a bullet that goes into a seam will go through one half (½) of the barrier through that seam. Thus, a 2-layer barrier must be larger relative to a 3-layer barrier to provide the same protection.

In a preferred embodiment of the present invention, the augmented wall contains no additional metal in the form of metal plates or shielding. While it is well known in the prior art references to incorporate metal for adding projectile resistance to structures, this is expensive and labor intensive. Additionally, the added metal increases the weight of the final product. The present invention achieves the same, or better, level of protection from bullets and projectiles without the added cost, labor, or weight associated with utilizing metal components in the wall.

While the present disclosure expresses a preferred embodiment consisting of ballistic concrete pavers for all of the multiple layers, one of skill in the art could choose to have one or more layers of non-ballistic concrete pavers with one or more layers of ballistic concrete pavers. By way of example and not limitation, the first two layers of ballistic paver blocks are followed by a non-ballistic paver block layer. Alternatively, a first layer of non-ballistic pavers is followed by one or more subsequent layers of ballistic concrete. Alternatively the non-ballistic paver is in-between two layers of ballistic paver blocks. It is of note that having the outer layers formed with ballistic concrete will reduce ricochets and spalling.

Alignment of Seams

While the present disclosure taught the advantages of having three layers with the ballistic paving blocks on each layer offset from one another so that the vertical seams and horizontal seams on any one layer did not overlap a different layer, this is not absolutely required in order to obtain many of the benefits of the present disclosure.

If the vertical and horizontal offsets are one third of the dimension of an uncut square ballistic panel block, then embodiments of the present invention which incorporate four layers of ballistic paver blocks is going to repeat the seam pattern in two layers.

A user may choose to have offsets of one half of an uncut square block so that the third layer repeats the seam pattern of the first layer. While this is not preferred embodiment, the chances of a bullet going through the seam on the outermost layer, passing through the middle layer where there is no seam and hitting exactly the seam on the bottom layer is low.

Use of Tongue and Groove Pavers

The use of tongue and groove for ballistic barriers to address the concern with seams is known. See U.S. Design Pat. No. D662,225 issued Jun. 19, 2012, which is hereby incorporated by reference in its entirety.

The use of tongue and groove could be used with ballistic paver blocks but is not preferred. Adding tongue and groove complicates the molding process with a ballistic paver block that is only a few inches thick. Specifically, the thin sections of tongue or grooves would be at risk of breaking. Additionally, tongue and groove would be more sensitive to imperfections from walls and floors that are imperfectly aligned. Tongue and groove would add complications when field cutting the pieces to create the seam offsets from layer to layer. However, especially if thicker ballistic panel blocks were used, tongue and groove might have appeal to some users.

Figure 6:
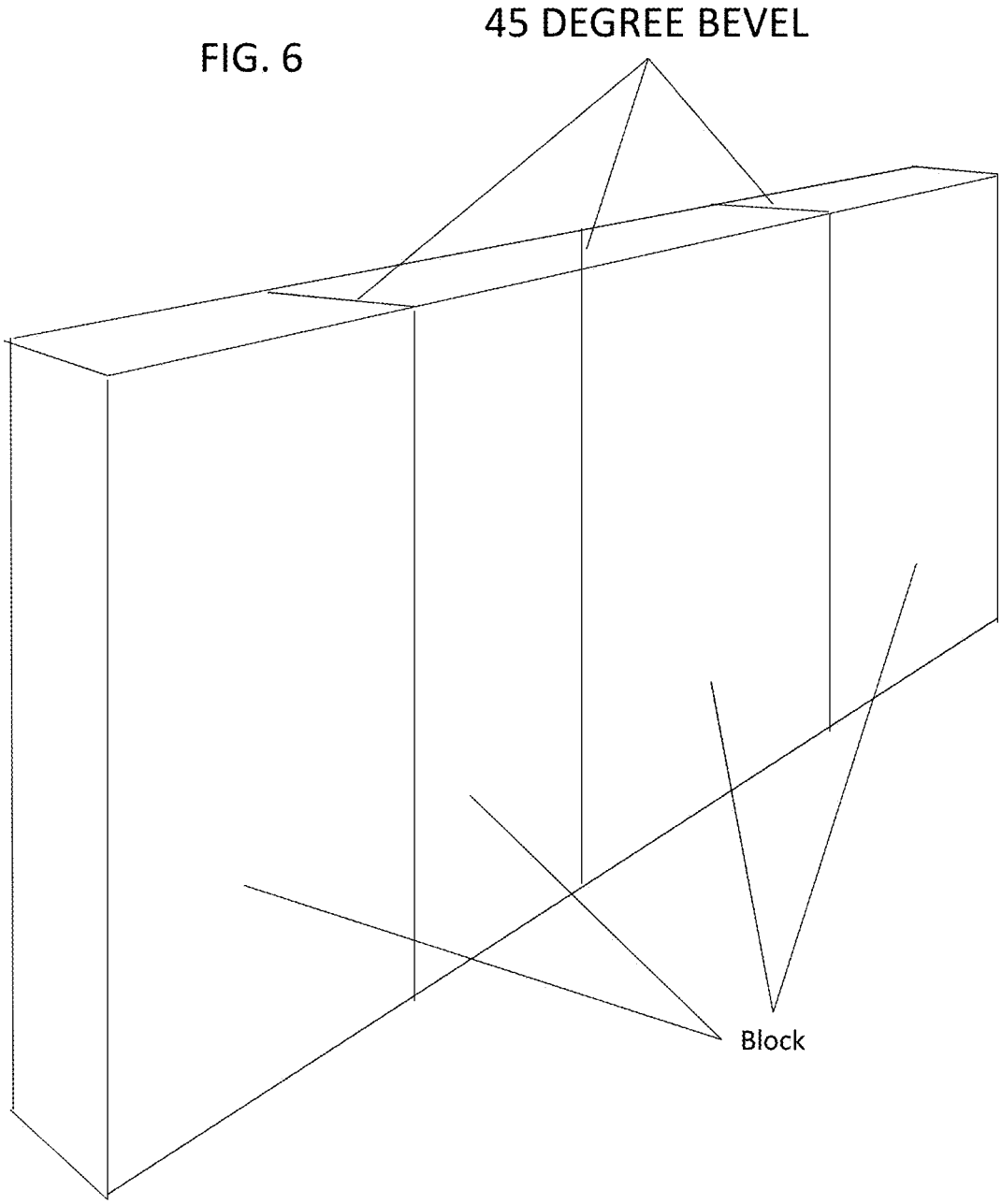
FIG. 6 illustrates an example embodiment of a block with two beveled edges according to the present invention.

In another embodiment of the present invention, the edges of the ballistic paver blocks are beveled. By way of example and not limitation, the vertical edges of the ballistic paver blocks are cut at a 45 degree angle to form beveled edges. Blocks are juxtaposed with alternating bevels to form a bevel joint, in order to eliminate gaps. FIG. 6 illustrates an example embodiment of blocks with two beveled edges fitted together according to the present invention. When the layers are configured as specified hereinabove using non-bevel block, the wall has no non-pinpoint seam overlaps, but still has pinpoint seam overlaps. Adding this bevel joint eliminates orthogonal pinpoint seam overlaps, which can exist with orthogonal blocks where vertical and horizontal edges cross.

Thus, the ballistic paver blocks are constructed, configured, and arranged to form a wall having at least three adjacent individual layers; wherein the blocks have beveled, juxtaposed vertical edges; and the layers are configured to provide no alignment of abutting edges between layers.

This reduces the assembly and manufacturing difficulties associated with tongue and groove blocks while providing enhanced protection from bullets or projectiles that hit the seam.

Protection Against Explosive Devices

This disclosure has disclosed a method of creating a wall that is hardened to make it unlikely that certain types of bullets fired from guns will traverse the wall protection. Nothing in this disclosure should be interpreted as limiting the use of the ballistic paver blocks to thwart only bullets but not shrapnel from grenades and various explosive devices such as a backpack bomb, a pressure cooker bomb such as used in the 2013 attack at the Boston Marathon, or other devices which may be called an improvised explosive device. The benefits of the present disclosure include hardening walls to resist penetration of the wall from materials propelled from an explosive device.

Outlets and other Utilities

In some instances an interior wall to be augmented with layers of ballistic paver blocks will have outlets for electricity, telephone or computer connections, or other utilities. Alternatively, an exterior wall may have a water spigot. In some instances, the choice will be made to retain these various utilities and cut the ballistic panel blocks to allow the old connections to be reached. In other instances, the utilities such as electrical or communication jacks will be extended and placed on the new inside wall. In one embodiment, the wires are placed in a conduit to reduce the opening to be left in the layers of ballistic paver blocks. Those of skill in the art will recognize that a bullet that finds the openings through the layers of ballistic panel blocks may traverse the wall and cause harm. The chances of a random shooter hitting a conduit path for an outlet from the other side of the wall is limited as there is not likely to be any indication on that side of the wall where the outlet or other utilities are located on the inside of the wall. A shooter is not likely to target a spigot on the exterior of the building.

Window Height Walls

In an augmented wall that incorporates windows, one embodiment of the present invention leaves the windows but adds layers of ballistic panel pavers to either surround the windows or to simply rise from the floor to the bottom edge of the windows. Alternatively, the ballistic paver blocks are added to the bottom 3 feet of the wall. Alternatively, the ballistic paver blocks are added to the bottom 6 feet of the wall. Alternatively the ballistic paver blocks are added to the wall at a height that coincides with the budget for the augmentation. These alternative embodiments are advantageous because persons in the room would be able to drop to the ground and be protected by the enhanced wall even while bullets striking the windows and possibly the upper nonaugmented section of walls may be penetrated, while also augmenting the wall in the most cost-effective way.

Ballistic Concrete

The present disclosure teaches the creation of components made from wet ballistic concrete prepared without an addition of preformed foam, as disclosed in U.S. Pat. No. 9,121,675 issued Sep. 1, 2015 by Amidon et al for Barrier for Absorbing Live Fire Ammunition and Uses Thereof; U.S. patent application Ser. No. 14/268,435, filed May 2, 2014 by Amidon et al. for Repair of Ballistic Concrete Panels; and U.S. patent application Ser. No. 13/449,420, filed Apr. 18, 2012 by Amidon et al. for Barrier for Absorbing Very High Power Bullets and Uses Thereof; all of these patent documents are incorporated herein by reference in their entirety.

One of skill in the art of ballistic concrete manufacturing would recognize that these materials are prepared on industrial scale and accordingly quantities and proportions may vary in accordance with industry norms. In addition, one skilled in ballistic concrete manufacturing would recognize that materials may be measured by volume or by timed delivery from a storage container.

The training with the live ammunition may be performed with at least one of the following types of weapons:

.22 caliber weapon, .38 caliber weapon, .40 caliber weapon, .45 caliber weapon, 5.56 mm weapon, 6.8 mm weapon, 7.62 mm weapon, 9 mm weapon or a grenade or other fragmentation device.

The following examples further illustrate the various teachings of the disclosure and are not intended to limit the scope of the claimed invention.

Preparation of Components for Use Live Fire Ammunition

The ingredients for making the ballistic concrete components are as follows:

Portland Cement 972 pounds (441 kilograms)
Fine Aggregate (SSD) 972 pounds (441 kilograms)
Water 466 pounds (211 kilograms)
Calcium Phosphate 9.72 pounds (4.41 kilograms)
Aluminum Hydroxide 9.72 pounds (4.41 kilograms)
DaraFill® Dry 11.4 ounces (323 grams)
Grace Fibers™ 14.8 pounds (6.71 kilograms)

In another system for describing the ingredient ratios, the ingredients for making the ballistic concrete components are as follows:

(a) about 1 part by mass Portland cement;
(b) about 0.5 to 1.5 part by mass fine aggregate;
(c) about 0.005 to 0.15 part by mass fiber;
(d) about 0.005 to 0.05 part by mass calcium phosphate;
(e) about 0.005 to 0.05 part by mass aluminum hydroxide; and
(f) about 0.0005 to 0.05 part by mass air entrainment additive, such that the bullet absorbing component is capable of passing the penetration test described above.

In one non-limiting embodiment, the bullet absorbing component comprises (a) about 0.8 to 1.2 part by mass fine aggregate;
(b) about 0.008 to 0.012 part by mass fiber;
(c) about 0.008 to 0.012 part by mass calcium phosphate;
(d) about 0.008 to 0.012 part by mass aluminum hydroxide; and
(e) about 0.0008 to 0.002 part by mass air entrainment additive.

In another non-limiting embodiment, the bullet absorbing component comprises (a) about 0.9 to 1.1 part by mass fine aggregate;
(b) about 0.009 to 0.011 part by mass fiber;
(c) about 0.009 to 0.011 part by mass calcium phosphate;
(d) about 0.009 to 0.011 part by mass aluminum hydroxide; and
(e) about 0.0009 to 0.0015 part by mass air entrainment additive.

Figure 7:
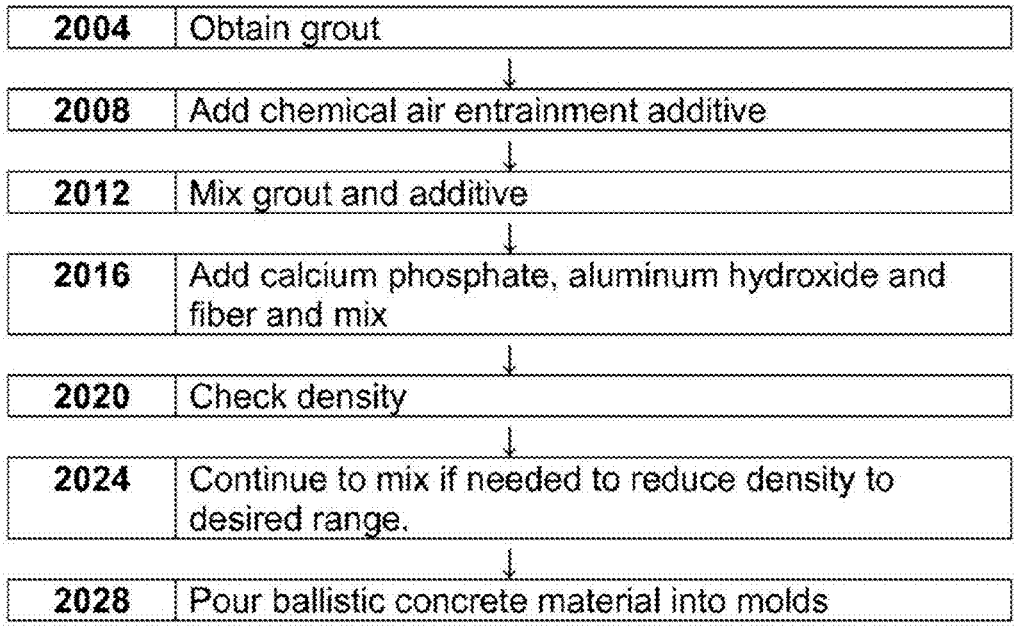
FIG. 7 summarizes the process 2000 for making bullet absorbing components using ballistic concrete made with chemical air entrainment additive rather than foam.

FIG. 7 summarizes a process 2000 for making bullet absorbing components using ballistic concrete made with chemical air entrainment additive rather than foam. As noted below, some of the steps may be performed in slightly different orders but for sake of clarity, it is useful to introduce one sequence of steps for discussion rather than muddy the water with premature digressions on alternatives. The steps may be summarized as follows:

Step 2004—Obtain a grout of Portland cement, fine aggregate, and water in a mixer in accordance with ACI standard 304R and/or ASTM standard C 94. The act of obtaining includes creating the grout or obtaining the grout from some third party.

Step 2008—Add a chemical air entrainment additive (DaraFill® Dry, W. R. Grace & Co.).

Step 2012—Following the addition of the additive, mix the grout for five minutes. Mixing may be achieved by rotating the drum on a cement mixer truck.

Step 2016—Add Calcium Phosphate, Aluminum Hydroxide, and fiber. One suitable fiber is Grace Fibers™ Mix for an additional ten minutes.

Step 2020—Check density such as by weighing using a ¼ cubic foot testing pot. Target weight is 17.5 pounds (approximately 70 pounds per cubic foot) as the actual target is 70 pounds per cubic foot +/−3 pounds per cubic foot. This lower density is necessary for capturing bullets from low-velocity guns, such as handguns, where the bullet velocity is about 950 ft/sec.

Alternatively, the composition may be mixed until the mixture has a density within a range of 88 to 94 pounds per cubic foot. The teachings of the present disclosure may be used to create a ballistic concrete without the use of the calcium phosphate and aluminum hydroxide if lead-leaching control is not an objective.

Step 2024—Continue to mix if needed to reduce density to desired range. Additional mixing lowers the density. Continue to mix, checking frequently, until target density is achieved. The target wet density material when poured into components is 1121 kg/m.sup.3 (70 pounds per cubic foot +/−3 pounds per cubic foot).

Step 2028—Pour ballistic concrete material into molds. As with traditional SACON® type ballistic concrete, vibration such as may be used with standard structural concrete is to be avoided to minimize destruction of air bubbles.

Changes in Order and Additives.

Note that the step of adding the calcium phosphate and aluminum hydroxide could be done at the same time as adding the chemical air entrainment additive.

Note further, that as the calcium phosphate and aluminum hydroxide are added to reduce lead-leaching from ballistic concrete blocks which have absorbed ammunition with lead components; these chemicals are not central to the ballistic properties of the ballistic concrete. Thus, in applications where the need to reduce lead-leaching is not important (whether because of local rules, post use disposal plans, or a movement to ammunition with minimal or no lead), one can make ballistic concrete in accordance with the teachings of the present disclosure without addition of calcium phosphate or aluminum hydroxide.

The fiber may be added at the same time as the chemical air entrainment additive (and possibly the calcium phosphate and aluminum hydroxide) as this process does not require achieving a pre-fiber density before adding the fiber. When the process is modified so that there is not a need to add material after five minutes of mixing, simply mix for fifteen minutes before checking density. Additional mixing may be required to reduce density.

After filling the molds, the material may be optionally tapped down with a rod to eliminate voids around embedments in the casting forms. Not all components will be poured into molds with embedments. Molds without embedments may not need a rod to eliminate any voids, but a form with an embedment such as a window cutout may need a treatment with a rod to eliminate voids.

Less Restrictions on Pouring.

Unlike traditional SACON® type ballistic material with fragile foam bubbles, ballistic material made in accordance with the teachings of the present disclosure is not limited to a 2 foot maximum drop during pouring or a 2 foot maximum depth of a pour. Thus, unlike traditional SACON® type ballistic material, ballistic material made in accordance with the teachings of the present disclosure may be poured into wall panels oriented in their final vertical orientation. Optionally, ballistic material made in accordance with the teachings of the present disclosure may be poured into molds with pour heights well in excess of 2 feet tall. Pours of greater than 3 feet in height are obtainable. Pours of greater than 6 feet in height are obtainable. Pours of greater than 8 feet in height from bottom to top of mold are obtainable. Pour structures of full height walls of 8 feet or more may be done.

Quicker Turn-Around on Use of Mold Components.

While traditionally, SACON® ballistic concrete components have been left in the molds for fourteen days with the sides only removed after three days, an alternative process viable with the improved ballistic concrete is to remove the sides of the forms within 24 hours and remove the bottom of the form after at least three days.

Those of skill in the art will recognize that the ability to remove the mold components significantly faster results in an overall throughput of molded panels of more than 300% for a given investment in molds. Thus, less money needs to be tied up in molds, transportation and storage of molds.

The component is wrapped in plastic to assure adequate hydration during curing. One of skill in the art will recognize that the timing of these steps may be adjusted based on weather conditions, particularly temperature but also factoring humidity. The components are allowed to harden and dry and are ready for use and/or testing after 28 days.

One of skill in the art will recognize that the fibers enhance the strength and resilience of the components and ability of the molded components to withstand a bullet entry without spalling. Spalls are flakes of material that are broken off a larger solid body such as the result of projectile impact, weathering, or other causes. It is desired that the molded components retain their structural integrity with the exception of the trail formed by the bullet entry. Thus while the fibers are important, one of skill in the art can identify and substitute other fibers that are suitable for the task, see e.g., paragraph defining term fiber in definitions section above. The choice of fibers will impact the overall density of the wet material as the weight of the fibers impact the density calculation.

Benefits of the Improved Bullet Absorbing Components

To date, the improved bullet absorbing components have consistently performed well in ballistic testing. Anecdotal evidence suggests significantly higher failure rates for traditional SACON® ballistic concrete than with the improved production process. These failure rates may be due to a lack of consistency of the product using traditional SACON® ballistic concrete. The improved production process produces a very consistent material with an extremely low (much less than 1%) failure rate of the penetration test listed above.

Other benefits for the improved ballistic concrete are the predictable and uniform results in ballistic performance when the mix falls within the target density range. By uniform results, it is meant that penetration tests on different parts of a panel made with the improved ballistic panel will all pass the penetration test.

The process is sufficiently predictable that when a sample falls outside of the target range for density after the prescribed mixing period, this aberrant result is a strong indicator that the sand used in the mix is out of specifications, perhaps because of inclusion of clay or another contaminant.

Cross-Sectional Characteristics

The bullet absorbing component may have air bubbles resulting from the air entrainment additive that are less than about 0.04 inches (1 mm) in diameter. Alternatively, the bullet absorbing component may have air bubbles resulting from the air entrainment additive that are greater than 0.0004 inches (10 microns) in diameter. In another non-limiting embodiment, the bullet absorbing component has air bubbles resulting from the air entrainment additive that are less than about 0.04 inches (1 mm) in diameter and greater than 0.0004 inches (10 microns) in diameter.

Ballistic Concrete Masonry Unit

A ballistic concrete masonry unit is also provided for by the present invention. The masonry unit is made using the ballistic concrete as described hereinabove. The ballistic concrete may be any density capable of performing the necessary absorption of rounds. In one embodiment, the ballistic concrete used is a lower density (about 70 lb/cu ft) to capture slower-moving projectiles. This embodiment can be further designed and configured to stop faster-moving projectiles. This range of functionality is achieved by configuring the thickness of the block to also stop the high-velocity rounds. To stop a high-velocity round, which is traveling at about 3300 ft/sec, the masonry unit needs to be at least about 20 cm (8 inches) inches thick. More preferably, the masonry unit is about 25 cm (10 inches) thick. Thus, using a combination of low density and appropriate thickness, the masonry unit can absorb and stop a wide range of projectiles.

Figure 8:
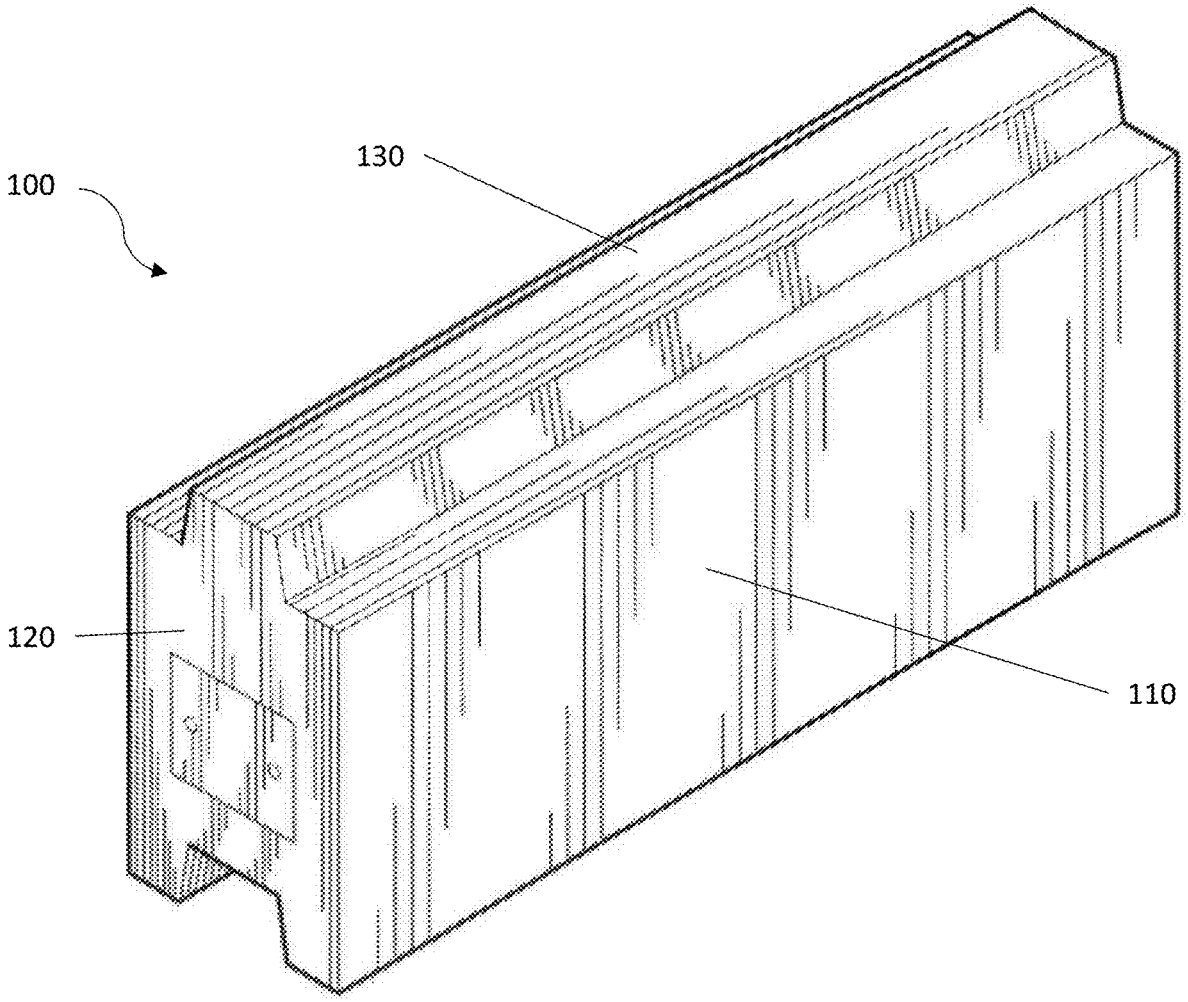
FIG. 8 is a perspective view of a ballistic concrete masonry unit according to the present invention.
Figure 9:
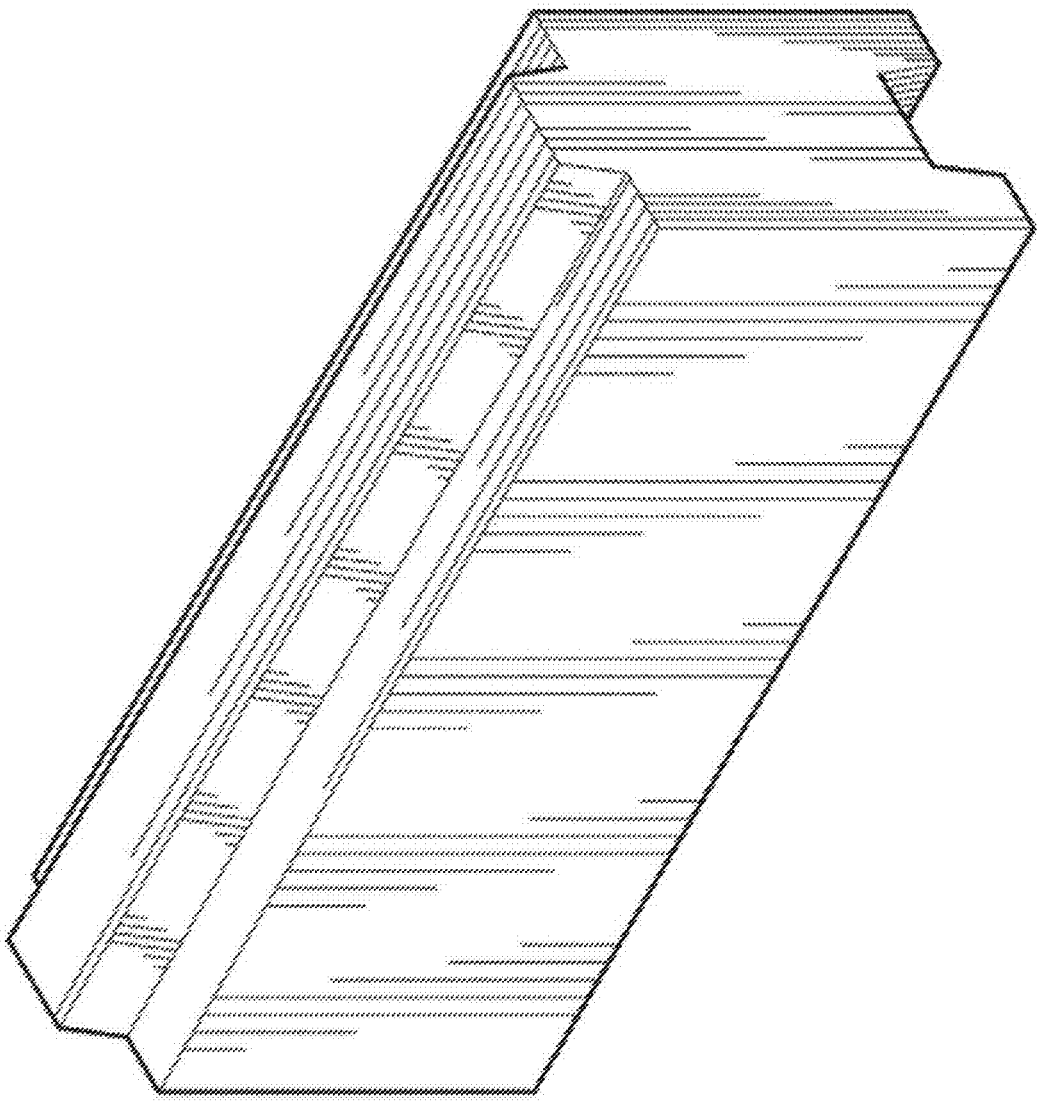
FIG. 9 is another perspective view of the ballistic concrete masonry unit of FIG. 8.
Figure 10:
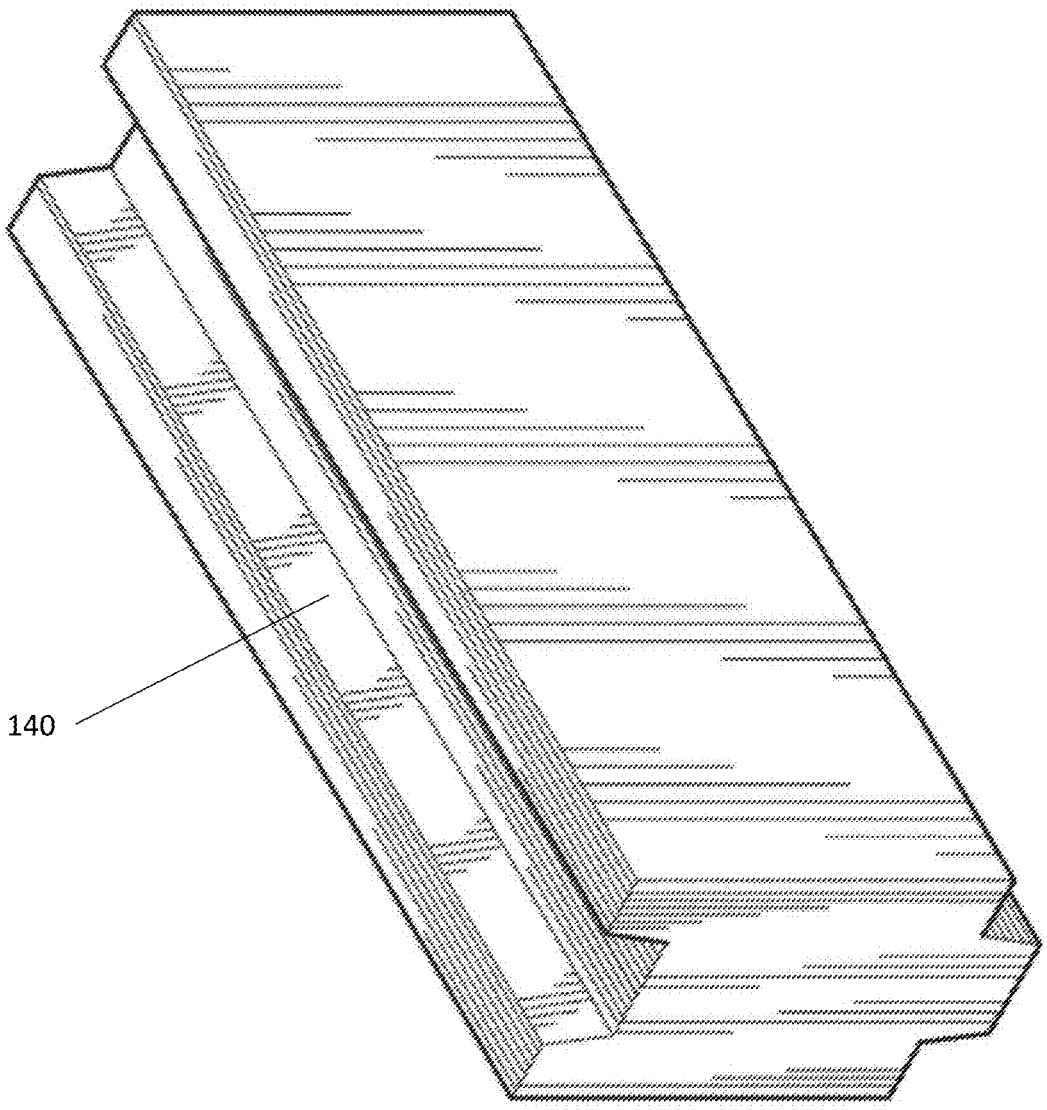
FIG. 10 is another perspective view of the ballistic concrete masonry unit of FIG. 8.
Figure 11:
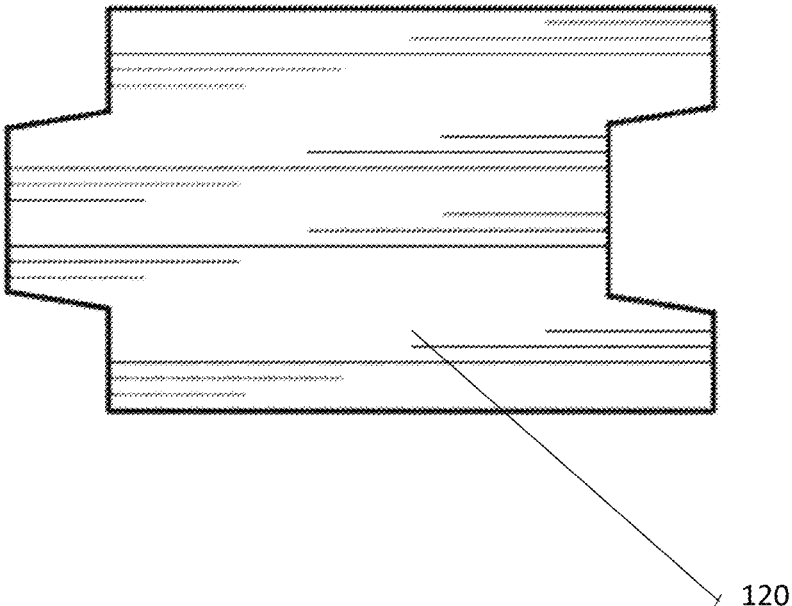
FIG. 11 illustrates an end view of the ballistic concrete masonry unit of FIG. 8.
Figure 12:
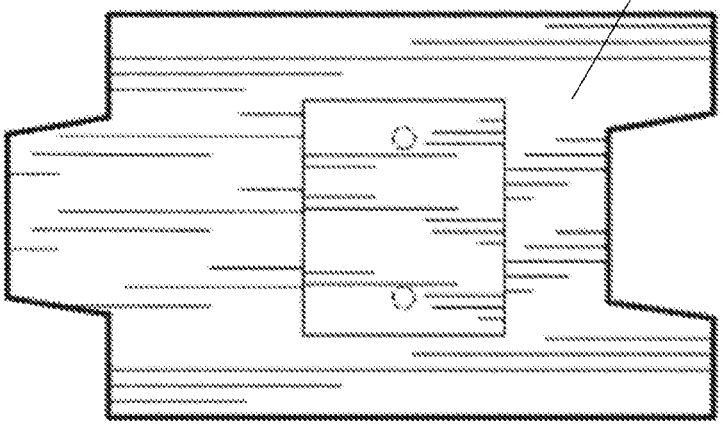
FIG. 12 illustrates another end view of the ballistic concrete masonry unit of FIG. 8.
Figure 13:
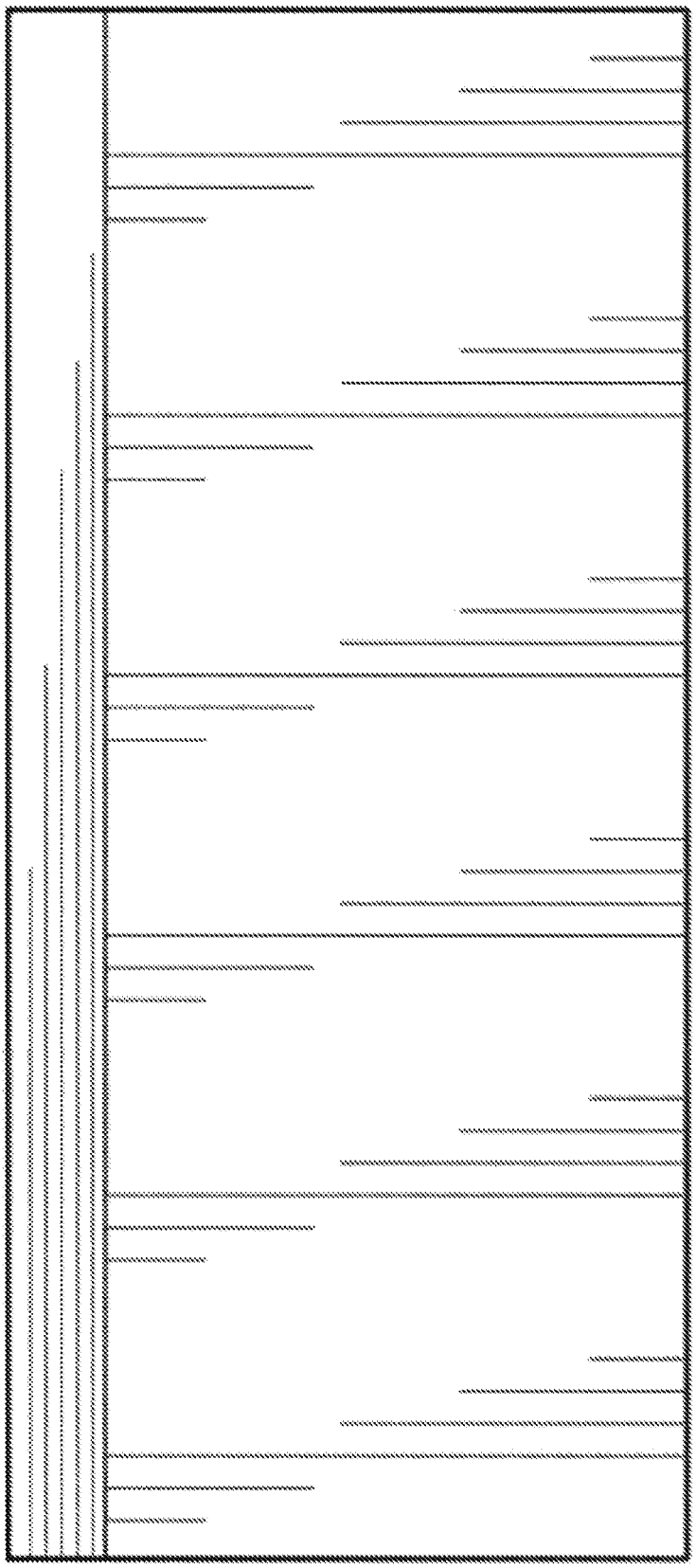
FIG. 13 is a side view of the ballistic concrete masonry unit of FIG. 8.
Figure 14:
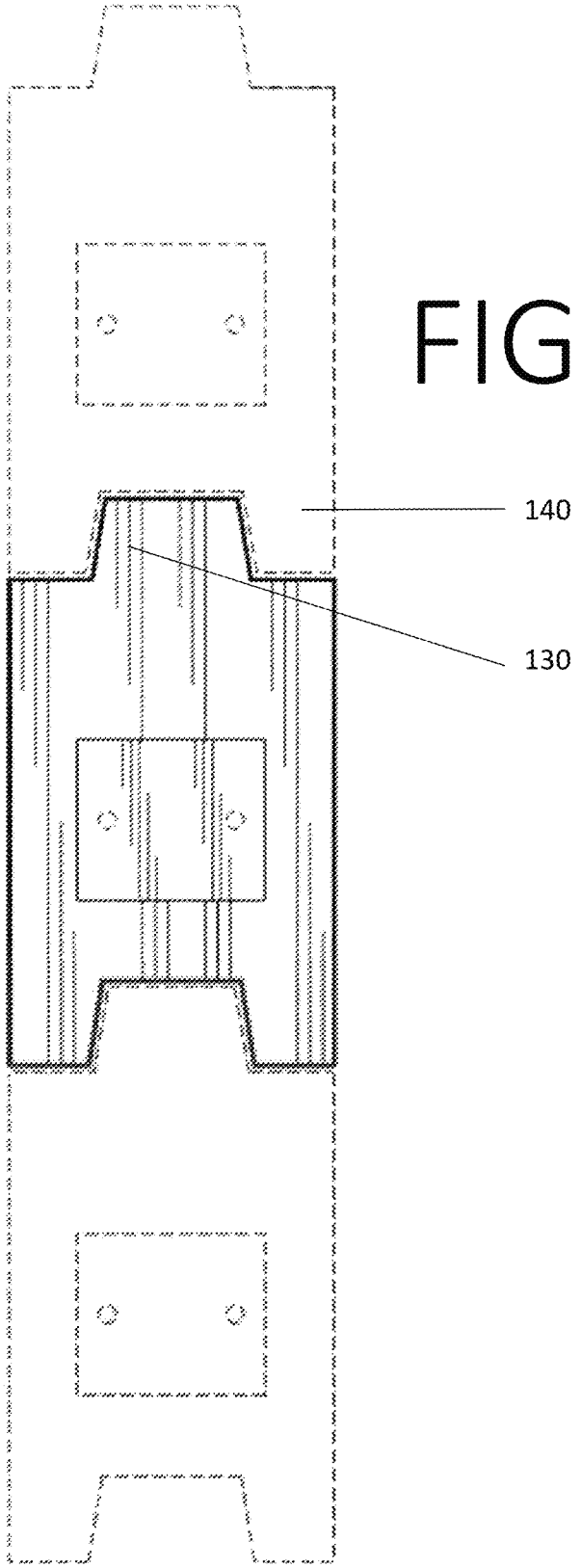
FIG. 14 is an end view of several ballistic concrete masonry unit of FIG. 8 stacked to form a wall.

The ballistic concrete masonry units are designed to matingly connect with tongue-and-groove edges. An example of this design is shown in U.S. Pat. No. D662225 issued Jun. 19, 2012 to Amidon et al. for a Precast Panel for Use in a Live-Fire Training Structure; incorporated herein by reference in its entirety. FIGS. 8-14 show the masonry unit from different views. FIGS. 8-10 are perspective views of the masonry unit. FIGS. 11 and 12 are end views. FIG. 13 is a side view. FIG. 14 is an end view of several ballistic concrete masonry units abutted to form a wall. Note that these units can be oriented vertically or horizontally. Other configurations can also be used without departing from the scope of the invention.

Thus, the present invention provides for a stackable concrete masonry unit made with ballistic cement as described herein.

Ballistic Concrete Wall

The present invention provides for a ballistic concrete wall made with the ballistic concrete as herein described. Unlike traditional SACON® type ballistic material with fragile foam bubbles, ballistic material made in accordance with the teachings of the present disclosure is not limited to a 2 foot maximum drop during pouring or a 2 foot maximum depth of a pour. Thus, unlike traditional SACON® type ballistic material, ballistic material made in accordance with the teachings of the present disclosure may be poured into wall panels oriented in their final vertical orientation. Optionally, ballistic material made in accordance with the teachings of the present disclosure may be poured into molds with pour heights well in excess of 2 feet tall. Pours of greater than 3 feet in height are obtainable. Pours of greater than 6 feet in height are obtainable. Pours of greater than 8 feet in height from bottom to top of mold are obtainable. Pour structures of full height walls of 8 feet or more may be done. Thus, the present invention provides for an integral ballistic concrete barrier much taller than possible with prior art ballistic cement compositions.

Cement sets when mixed with water by way of a complex series of chemical reactions still only partly understood. The different constituents slowly crystallize and the interlocking of their crystals gives cement its strength. When fresh cement is poured over cement that has already hardened, the crystal cannot interlock as thoroughly as a single pour. Thus, the present invention provides for taller barriers that are stronger because they are integrally-formed in a single pour.

The walls thus formed can be designed and configured to capture low- and high-velocity rounds, as previously described. Thus, a wall with density about 70 lb/cu.ft. that is about 20 cm (8 inches) thick can capture both low- and high-velocity rounds.

The above-mentioned examples are provided to serve the purpose of clarifying the aspects of the invention, and it will be apparent to one skilled in the art that they do not serve to limit the scope of the invention. By way of example, the exterior walls can be measured and ballistic concrete can be poured on-site into forms, thereby limiting seams and labor costs associated with layering numerous ballistic paver blocks. By its nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

The invention claimed is:

1. A bullet resistant wall system comprising:

at least three layers of units comprising an innermost layer, a middle layer, and an outermost layer;

wherein at least two of the at least three layers of units comprise ballistic concrete units; and wherein the at least three layers of units are arranged to provide no pinpoint seam overlap between the at least three layers.

2. The bullet resistant wall system of claim 1, wherein at least one of the ballistic concrete units is formed with a maximum pour drop of the ballistic concrete of the at least one of the ballistic concrete units exceeding 2 feet.

3. The bullet resistant wall system of claim 1, wherein the ballistic concrete units have beveled, juxtaposed vertical edges.

4. The bullet resistant wall system of claim 3, wherein the beveled, juxtaposed vertical edges comprise a 45-degree bevel.

5. The bullet resistant wall system of claim 1, wherein both the innermost layer and the outermost layer have a density that is lower than the middle layer.

6. The bullet resistant wall system of claim 1, wherein the innermost layer has a higher density than the middle layer, and wherein the middle layer has a higher density than the outermost layer.

7. The bullet resistant wall system of claim 1, wherein horizontal edges of each layer of ballistic concrete units are staggered by a minimum of at least two inches vertically.

8. The bullet resistant wall system of claim 1, wherein vertical edges of each layer of ballistic concrete units are staggered by a minimum of at least two inches horizontally.

9. The bullet resistant wall system of claim 1, wherein the at least three layers of units have no other materials between any two layers.

* * * * *